US006880299B2

(12) United States Patent
Martin

(10) Patent No.: US 6,880,299 B2
(45) Date of Patent: Apr. 19, 2005

(54) CONSTRUCTION MATERIAL WITH MULTIPLE STUD POSITION INDICIA

(76) Inventor: Thomas E. Martin, 202 Stone Point La., Jacksonville, NC (US) 28540

( * ) Notice: Subject to any disclaimer, the term of this patent is extended or adjusted under 35 U.S.C. 154(b) by 0 days.

(21) Appl. No.: 10/224,259

(22) Filed: Aug. 20, 2002

(65) Prior Publication Data

US 2004/0035062 A1 Feb. 26, 2004

(51) Int. Cl.[7] ..... E04B 1/00

(52) U.S. Cl. ..... 52/105; 52/745.19; 52/481.1; 428/195.1; 428/211

(58) Field of Search ..... 52/105, 745.19, 52/481.1; 428/195.1, 537.1, 537.5, 537.7, 211; 33/1 B

(56) References Cited

U.S. PATENT DOCUMENTS 3,541,745 A * 11/1970 Probst ..... 52/105
3,763,609 A * 10/1973 Probst ..... 52/105
4,397,123 A 8/1983 Parker
4,554,196 A * 11/1985 Meeker ..... 428/67
4,584,224 A 4/1986 Schneller
4,858,402 A * 8/1989 Putz ..... 52/105
4,870,788 A * 10/1989 Hassan ..... 52/105
4,924,644 A 5/1990 Lewis
4,927,696 A * 5/1990 Berg ..... 428/195.1
5,230,200 A 7/1993 Douglas et al.
5,924,213 A * 7/1999 Lee ..... 33/494
5,950,319 A 9/1999 Harris
6,012,255 A 1/2000 Smid et al.
6,049,987 A * 4/2000 Robell ..... 33/1 B
6,115,926 A 9/2000 Robell
6,269,595 B1 8/2001 Blubaugh et al.
6,539,643 B1 * 4/2003 Gleeson ..... 33/563
2003/0211305 A1 * 11/2003 Koval et al. ..... 428/292.4

* cited by examiner

*Primary Examiner*—Carl D. Friedman
*Assistant Examiner*—Chi Q Nguyen
(74) *Attorney, Agent, or Firm*—Dale J. Ream

(57) ABSTRACT

A construction material includes a panel having opposed side walls and upper and lower walls extending longitudinally between the side walls. The panel includes front and rear surfaces. A first sheet of paper is adhered to a front surface of the panel. A first set of indicia arranged in linear relation are imprinted upon the sheet, respective lines being spaced a first predetermined distance apart. A second set of indicia arranged in linear relation are imprinted on the sheet and spaced a second predetermined distance apart. The first and second predetermined distances are different and correspond to different wall support constructions. The first and second sets of indicia also include different shape and color indicia. The side, upper, and lower walls are sloped from the front surface toward the rear surface to form respective butt joints.

6 Claims, 4 Drawing Sheets

CONSTRUCTION MATERIAL WITH MULTIPLE STUD POSITION INDICIA

BACKGROUND OF THE INVENTION

This invention relates generally to construction materials and, more particularly, to a drywall panel having sets of indicia in linear arrangements and spaced apart at respective predetermined distances indicative of the location of wall supports using at least two relative measurement scales.

Drywall panels and other similar construction materials are often positioned and secured to a plurality of wall supports with nails or screws. Correctly positioning and directing the nails or screws through the panel and into the wall support studs is a significant challenge. In fact, finding a stud is often a trial and error process. Once a stud is found, the carpenter sometimes draws a straight line across the panel so as to indicate the position of the stud so that additional fasteners may be driven or screwed through the panel and into the stud. Once all of the drywall panels for a wall structure have been secured, drywall spackle or mud is spread over the seams and sanded smooth. It is another great challenge to apply and sand the seams without leaving raised or bulging seam lines.

Various construction materials have been proposed in the art for indicating stud positions. The existing materials, however, do not provide both vertical and horizontal indicia indicative of the position of wall supports having various spacing arrangements. Further, the existing construction materials do not provide perimeter configurations that assist in minimizing or eliminating raised or bulging seams between multiple panels.

Therefore, it is desirable to have a construction panel that provides both vertical and horizontal indicia that indicate the position of wall supports whether the construction material is situated horizontally or vertically and whether the wall supports are arranged 16 or 24 inches on center. Further, it is desirable to have a construction panel having perimeter configurations that minimize or eliminate raised mud seams between panels.

SUMMARY OF THE INVENTION

A construction material according to the present invention includes a panel of gypsum board having opposed side walls with longitudinal upper and lower walls extending between the side walls. The panel presents front and rear surfaces, each having a generally rectangular configuration. The side, upper, and lower walls have a configuration sloping from the front surface toward the rear surface. This perimeter configuration presents butt joints along all sides such that drywall mud may be received therein as the seams between panels are mudded. These joints minimize the depth of mud applied to the seams and, therefore, minimize bulging or raised seams.

A sheet of drywall paper is adhered to the front surface of the panel and includes a first set of indicia arranged in a first set of lines. The first set of lines are equally spaced a first predetermined distance apart and each line extends continuously between the upper and lower walls. Each indicium of the first set of indicia may include uniform shape and color characteristics. A second set of indicia is substantially similar to the first set of indicia except that a second set of lines is spaced apart according to a second predetermined distance that is different than the first predetermined distance. Also, each indicium of the second set of indicia includes shape and color characteristics different from those of the first set of indicia. For example, the first set of indicia may be arranged along lines that are separated so as to correspond to studs that are 16" on center while the second set of indicia may be arranged along lines corresponding with studs that are 24" on center. Each set of lines includes different shape and color characteristics so as to further distinguish them. Third and fourth sets of indicia may also be imprinted on the paper perpendicular to the first and second sets. These sets of indicia are arranged in lines extending between side walls of the panel and are useful for identifying wall supports when the panel is being attached thereto in a vertical orientation.

Therefore, a general object of this invention is to provide a construction material having indicia that indicates the relative position of wall supports on at least two different relative scales.

Another object of this invention is to provide a construction material, as aforesaid, in which the indicia are provided both horizontally and vertically.

Still another object of this invention is to provide a construction material, as aforesaid, in which each set of indicia includes shape or color characteristics for distinguishing therebetween.

Yet another object of this invention is to provide a construction material, as aforesaid, having perimeter wall configurations that minimize bulging seams when said seams are covered with drywall mud.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
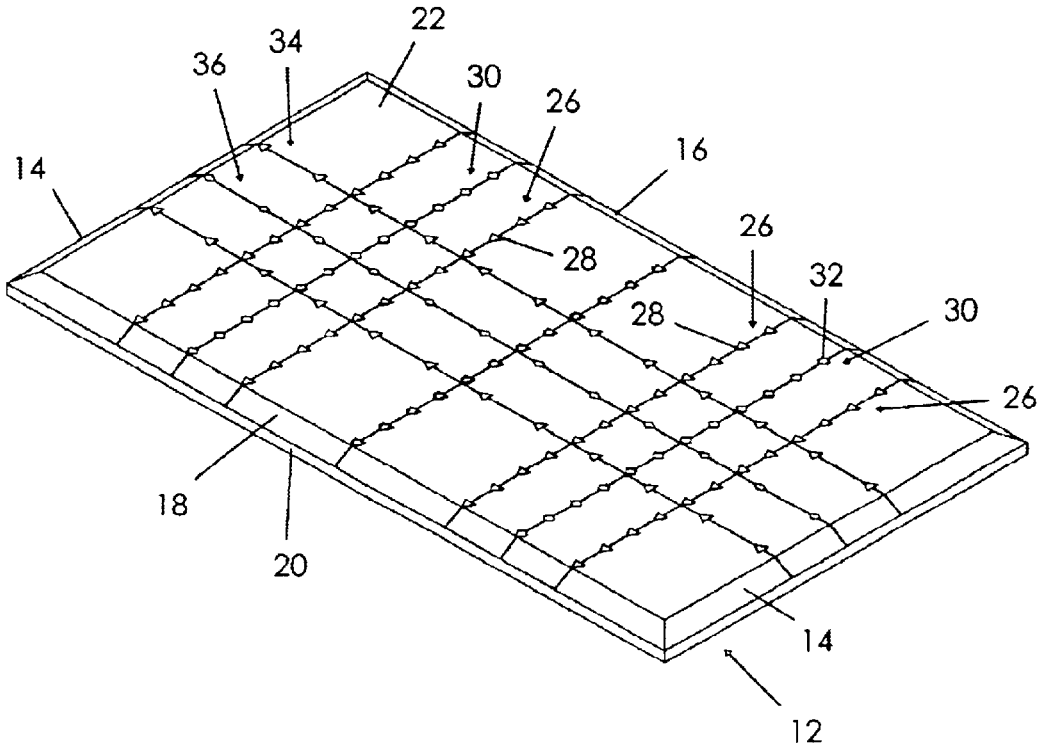
FIG. 1 is a perspective view of a construction material according to a preferred embodiment of the present invention.

A construction material 10 according to a preferred embodiment of the present invention will now be described in detail with reference to FIGS. 1 through 4 of the accompanying drawings. The construction material 10 includes a panel 12 constructed of gypsum board although the principles taught by this invention would also work with other panels, such as plywood. The panel 12 presents a thickness and includes front and rear surfaces having generally rectangular configurations. The panel 12 further includes opposed side walls 14 and upper 16 and lower 18 walls extending longitudinally between the side walls 14. These walls define the perimeter of the panel 12.

The side walls and upper 16 and lower 18 walls are sloped from the front surface toward the rear surface of the panel 12. Although the walls are sloped substantially the entire distance between the front and rear surfaces, a portion 20 of each wall immediately adjacent the rear surface may maintain a configuration perpendicular to the rear surface (FIG. 1). The sloped configuration of the side 14, upper 16, and lower 18 walls may be formed at the point of manufacture.

Large rollers may be used to "indent" the surface of a sheetrock panel to the desired configuration. The sloped configuration about the perimeter of the panel 12 establishes butt joints entirely thereabout, as to be further described later.

Figure 4:
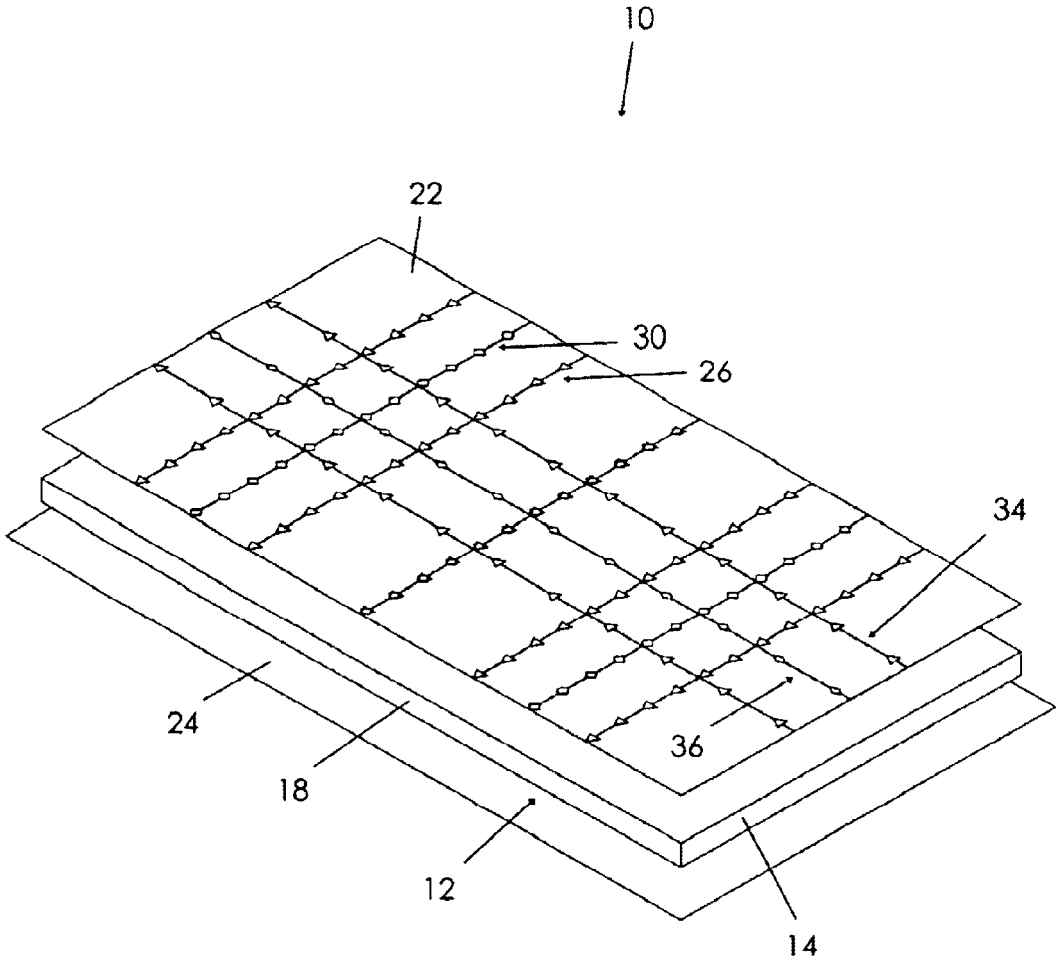
FIG. 4 is an exploded view of the construction material as in FIG. 1.

A sheet of sheetrock paper 22 is applied and adhered to the front surface of the panel 12 (FIGS. 1 and 4). This top paper layer includes a configuration substantially similar to the panel configuration such that the paper 22 substantially covers the front surface and side 14, upper 16, and lower 18 walls thereof. A bottom paper layer 24 is similarly adhered to the rear surface of the panel 12.

Figure 2:
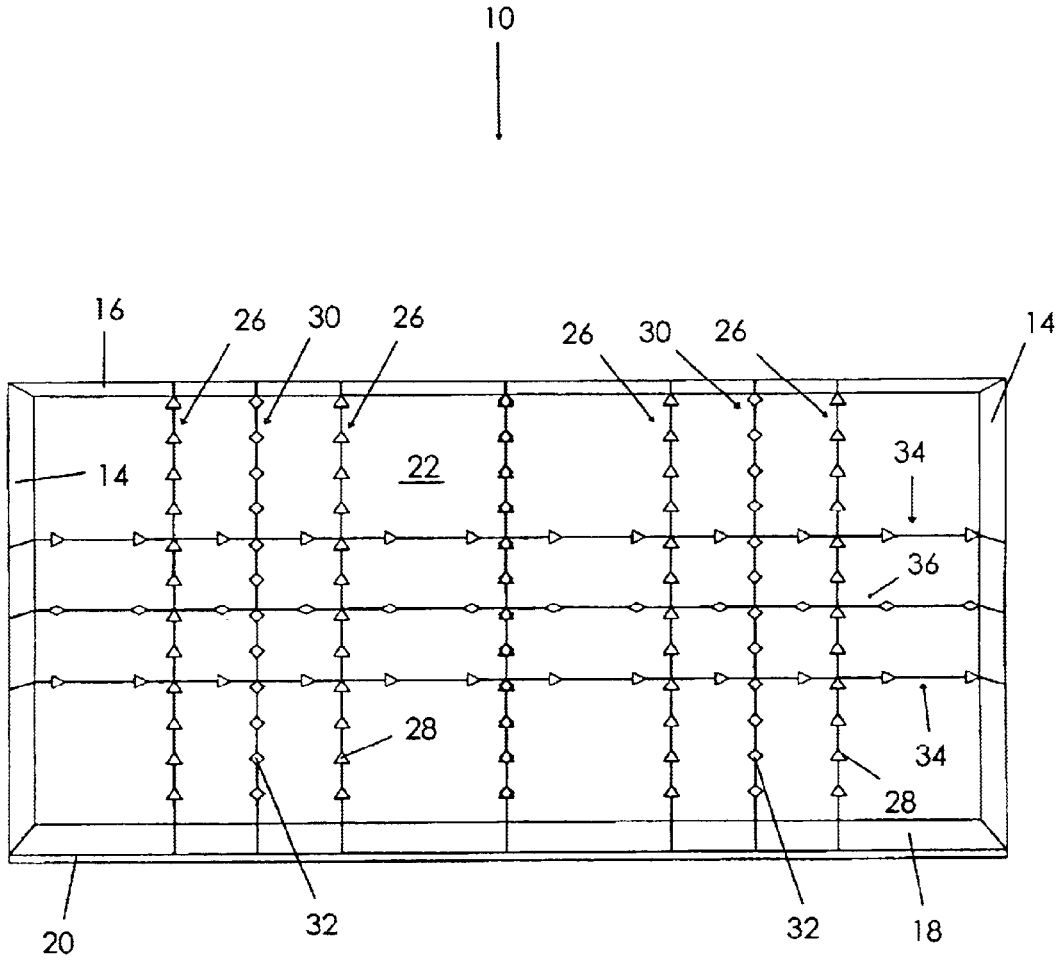
FIG. 2 is an elevated perspective view of the construction material as in FIG. 1.

At least two sets of indicia are imprinted on the top layer paper 22. More particularly, a first set of indicia 26 is arranged in a first set of parallel lines, each line extending continuously between upper 16 and lower 18 walls of the panel 12 (FIG. 2). Each of the first set of lines is spaced apart according to a first predetermined distance interval, such as 16 inches apart. The first set of lines includes a center line extending between upper 16 and lower 18 walls at a point midway between the opposed side walls 14. Additional of the first set of lines are displaced from this center line according to the first predetermined distance. Each indicium 28 of the first set of indicia 26 includes a first shape. For example, a plurality of triangular shaped indicia are imprinted along the first set of lines. As shown in the accompanying drawings, each shape indicium is separated longitudinally along a corresponding line although it is understood that such separation is not required. The first set of indicia 26 further include a common color. Therefore, the first set of indicia 26 arranged in the first set of lines and along with the corresponding shape and color characteristics enable a carpenter to insert nails or screws through the panel 12 and into respective wall supports.

Figure 3:
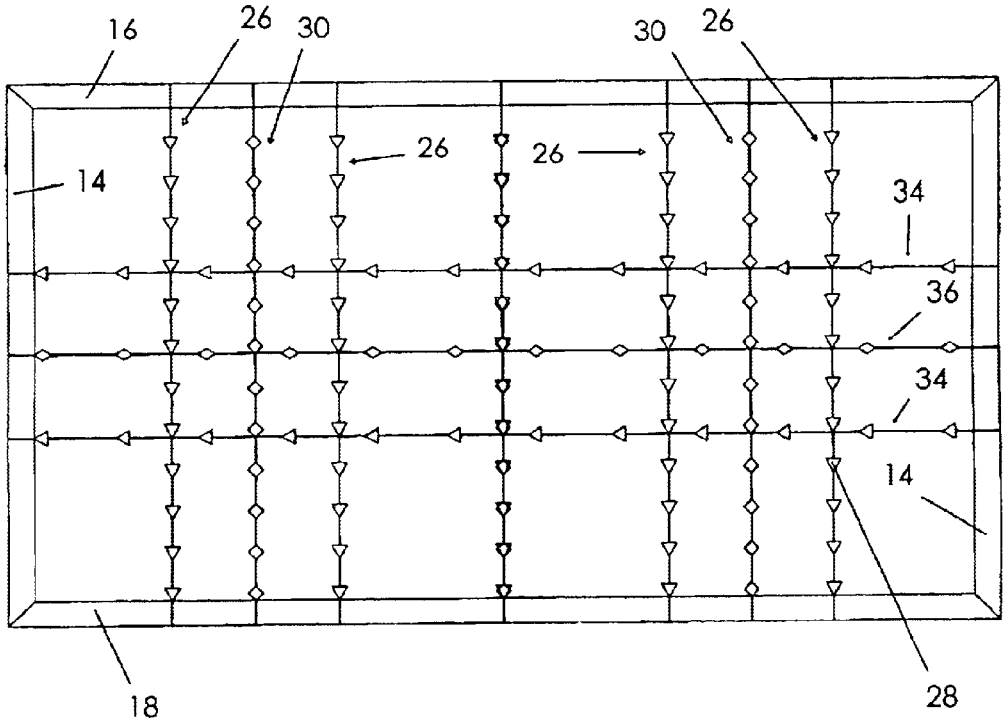
FIG. 3 is a front view of the construction material as in FIG. 1.

A second set of indicia 30 is also imprinted on the top layer paper 22 and includes a second set of lines extending continuously between upper 16 and lower 18 walls and spaced apart according to a second predetermined distance interval (FIG. 3). The second distance interval is different than the first distance interval. For example, the second distance interval may be 24 inches. Thus, the second set of lines correspond to wall supports arranged in 24" on center relation. Each indicium 32 of the second set of indicia 30 includes a shape that is different than the shape of each indicium 28 of the first set of indicia 26, each indicium 32 being spaced apart longitudinally. For example, each indicium 32 of the second set of indicia 30 may include a diamond shaped configuration. The second set of indicia 30 is imprinted in a color different from the color of the first set of indicia 26. Accordingly, a carpenter may utilize the appropriate set of indicia to locate wall supports depending on whether the wall supports are 16" or 24" on center.

A third 34 and fourth 36 set of indicia may also be imprinted on the top layer paper 22 (FIG. 3). The third set of indicia 34 includes a construction substantially similar to the construction of the first set of indicia 26 described above except that the lines of indicia extend between the opposed side walls 14. The fourth set of indicia 36 includes a construction substantially similar to the construction of the second set of indicia 30 described above except that the parallel lines of indicia extend between the side walls 14 instead of between the upper 16 and lower 18 walls. The lines of the third set of indicia 34 are spaced apart according to the first predetermined distance interval described above while the lines of the fourth set of indicia 36 are spaced apart according to the second predetermined distance interval. Therefore, the third 34 and fourth 36 sets of indicia may be used to identify the location of vertical wall supports when the panel 12 is being attached in a vertical orientation.

It is understood that the top layer of paper 22 may be imprinted before or after the paper is adhered to the panel (FIG. 4). In the case of pre-printing, the paper 22 is rolled from a large paper spool and imprinted with ink as it passes through an appropriate printing device. In use with gypsum, the paper is simply positioned thereon and adheres thereto as the wet gypsum dries. Imprinting the sets of indicia prior to adhering the paper to the gypsum panel provides a more even printing surface.

In use, a user must first determine the spacing of the supports/studs of the wall to which a construction material 10 is to be attached, i.e. if the supports are 16" or 24" on center. This determines which set of indicia the user will follow during attachment. The panel 12 may then be positioned on the wall such that at least one of the appropriate lines is aligned with a wall support. Once nails or screws are inserted through the panel and into a corresponding support, additional nails/screws may be inserted along the chosen set of lines in order to ensure that corresponding studs are found. Once multiple panels have been attached to the wall, sheetrock mud may be applied to cover the seams between the panels. The sloped configuration of adjacent side 14, upper 16, and lower 18 walls form grooves within each seam capable of retaining sheetrock mud therein. Therefore, adequate amounts of mud may be applied to cover the seams but without forming raised or bulging seams. Excess mud may be scraped or sanded away to provide a smooth surface over the seams and even with the plane of the panel front surfaces. Unlike traditional sheetrock, the butt joints of the present invention allows for a nearly seamless-appearing final result.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A construction material for attachment to a plurality of evenly spaced apart wall supports, said construction material comprising:

a panel having a generally rectangular configuration with a pair of opposed side walls and upper and lower walls extending longitudinally between said side walls, said panel having front and rear surfaces with a thickness therebetween;

a sheet of paper secured to and substantially covering said front surface of said panel;

wherein said rear surface includes a circumference greater than a circumference of said front surface;

wherein each said side wall includes a first portion immediately adjacent and perpendicular to said rear surface and an angled second portion connecting said first portion to said front surface, whereby said side walls are sloped substantially between said front and rear surfaces so as to form side butt joints;

wherein said upper and lower walls each include a first portion immediately adjacent and perpendicular to said rear surface and an angled second portion connecting the respective first portion to said front surface, whereby said upper and lower walls are sloped substantially between said front and rear surfaces so as to form upper and lower butt joints;

a first set of indicia imprinted in a continuously extending fashion upon said sheet of paper and arranged in a first set of substantially parallel lines, said first set of lines extending between said upper and lower walls and having a first predetermined distance therebetween;

a second set of indicia imprinted in a continuously extending fashion upon said sheet of paper and arranged in a second set of substantially parallel lines, said second set of lines extending between said upper and lower walls and having a second predetermined distance therebetween;

wherein said second predetermined distance is different than said first predetermined distance; and wherein said second set of indicia is different than said first set of indicia.

2. The construction material as in claim 1 wherein said panel is a gypsum board.

3. The construction material as in claim 1 further comprising:

a third set of indicia imprinted in a continuously extending fashion upon said sheet of paper and arranged in a third set of substantially parallel lines, said third set of lines extending between said side walls and having said first predetermined distance therebetween; and a fourth set of indicia imprinted in a continuously extending fashion upon said sheet of paper and arranged in a fourth set of substantially parallel lines, said fourth set of lines extending between said side walls and having said second predetermined distance therebetween.

4. The construction material as in claim 1 wherein each indicium of said first set of indicia includes a first shape and each indicium of said second set of indicia includes a second shape different from said first shape.

5. The construction material as in claim 4 wherein said each indicium of said first set of indicia includes a first color and said each indicium of said second set of indicia includes a second color different from said first color.

6. The construction material as in claim 1 wherein an indicium of said first set of indicia includes a first color and an indicium of said second set of indicia includes a second color different from said first color.

* * * * *